United States Patent [19]

Morihashi

[11] 4,112,658

[45] Sep. 12, 1978

[54] SPINNING APPARATUS FOR SPUN YARN

[75] Inventor: Toshihumi Morihashi, Kyoto

[73] Assignee: Murata Kikai Kabushiki Kaisha, Kyoto, Japan

[21] Appl. No.: 682,272

[22] Filed: May 3, 1976

[30] Foreign Application Priority Data

May 6, 1975 [JP] Japan ..... 50-55003

[51] Int. Cl.[2] ..... D01H 5/28

[52] U.S. Cl. ..... 57/51; 57/5; 57/34 AT; 57/77.3; 57/157 F

[58] Field of Search ..... 57/36, 34 AT, 51–51.6, 57/5, 144, 160, 157 F

[56] References Cited

U.S. PATENT DOCUMENTS

| | | | |
|---|---|---|---|
| 3,079,746 | 3/1963 | Field, Jr. | 57/144 X |
| 3,367,095 | 2/1968 | Field, Jr. | 57/5 |
| 3,775,955 | 12/1973 | Shah | 57/34 AT |
| 3,802,174 | 4/1974 | Landwehrkamp et al. | 57/51 X |
| 3,978,648 | 9/1976 | Yamagata et al. | 57/51 X |

*Primary Examiner*—John Petrakes

*Attorney, Agent, or Firm*—Whittemore, Hulbert & Belknap

[57] ABSTRACT

This invention relates to a spun yarn spinning machine of the air injection type, which has first and second yarn twisting devices disposed between front rollers and delivery rollers. These first and second yarn twisting devices have air injection nozzles for injecting air obliquely fed toward the delivery roller side. These air injection nozzles of the first and second yarn twisting devices open into the cylindrical yarn passages of the yarn twisting devices so that the twisting directions of the yarns are in counter direction with each other tangentially of the passages at a predetermined angle with respect to the central axis of the passages of the first and second yarn twisting devices. The first yarn twisting device also has an untwisting device associated therewith for loosening the fibers before the fibers once twisted by the injected air in the first yarn twisting are fed into the second yarn twisting device.

4 Claims, 9 Drawing Figures

SPINNING APPARATUS FOR SPUN YARN

BACKGROUND OF THE INVENTION

This invention relates to an air injection type spinning machine.

Since the air injection type spinning machine does not have mechanically rotating parts compared with the conventional twisting type ring spinning machine, its yarn feeding speed is greatly increased, and as the air injection type spinning machine also has straight yarn feeding, it is not limited by the length of fibers as the conventional rotor type open end spinning machine is.

Heretofore, in the conventional air injection type spinning system, fibers are arranged in a predetermined thickness by means of a drafting device, and the spun yarn is formed by utilizing the turbulence of the arranged fibers occasioned by a drafting action, draft rollers and the fact that unrestricted fibers produced by the twisting action transmitted from a twisting device are passed through the twisting device by the compressed injection air so that the twist of relief is retained after the fibers are untwisted or twisted.

SUMMARY OF THE INVENTION

It is, therefore, an object of the present invention to provide a spun yarn spinning apparatus which can produce a spun yarn having uniform appearance and good strength.

It is another object of the present invention to provide an air injection type spinning machine which can control the strength of the spun yarn.

In order to perform the aforementioned and other objects of the present invention, the air injection type spinning machine of this invention provides means for actually and positively twisting the filaments of the yarn or fibers in addition to the entangled or intertwined fibers accidentally taken place so as to provide spun yarn having uniform appearance and sufficient strength when the spun yarn is fed out of the spinning machine without being cut for a long time. Also the strength of the spun yarn fed out of the machine is controlled by the number of twists in the spinning machine.

The invention in air injection type spinning machine taken with further objects and advantages thereof, will best be understood by reference to the following description taken in conjunction with the accompanying drawings.

DETAILED DESCRIPTION OF THE PREFERRED EMBODIMENTS

Figure 1:
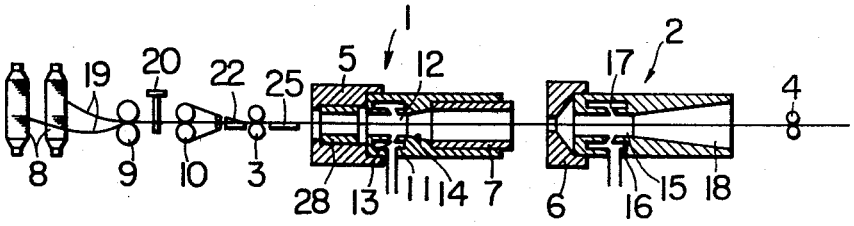
FIG. 1 is an explanatory view of a spun yarn spinning machine constructed according to the present invention.

Referring to the drawings, there is illustrated schematically an air injection type spinning machine constructed in accordance with the present invention.

The air injection type spinning machine of this invention has first and second yarn twisting devices 1 and 2 located between front rollers 3 and delivery rollers 4, balloon control rings 5 and 6 provided at the front rollers sides of both the first and second yarn twisting devices 1 and 2, respectively for stabilizing the balloon, an untwisting tube 7 provided at the delivery rollers side of the first yarn twisting device 1 for positively untwisting and loosening the fibers in contact of the balloon so as to spin the yarn similar to the ring spun yarn.

Referring now to FIG. 1, the detailed description will be made with respect to the components of the air injection type spinning machine of the invention. The fibers fed from drawing yarn bobbins 8 or silver cans are expanded to a predetermined width or thickness through back rollers 9, aprons 10 and front rollers 3. A larger drafting rate is better in the spinning machine of this invention than that used in the ordinary ring spinning machine. According to the experiments, 1.5 to 2 times the ordinary drafting rate did not harm the quality of yarns. Since the drafting rate is large, it is necessary to supply thicker staple fibers to the spinning machine of this invention than those supplied to the ring spinning machine.

Figure 2:
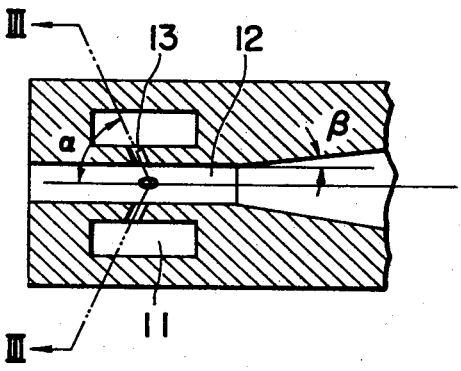
FIG. 2 is an enlarged partial sectional view of the spinning machine showing the air injection nozzle.
Figure 3:
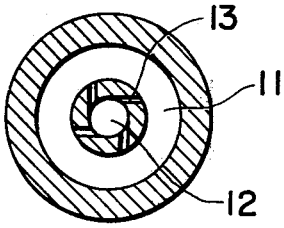
FIG. 3 is a sectional view of the air injection nozzle taken on the line III — III in FIG. 2.

The first yarn twisting device 1 has a chamber 11 to which compressed air is fed through a pipe connected to an air compressor (not shown), and this chamber 11 of the first yarn twisting device 1 has plural air injection nozzles 13 opened at a yarn path or cylindrical yarn passage 12 formed through the first yarn twisting device 1 in a manner being inclined at $\alpha°$ with respect to the central axis of the cylindrical yarn passage 12 as shown in FIG. 2. If the compressed air is injected from these nozzles 13 into the cylindrical yarn passage 12 of the first yarn twisting device 1, the air in the yarn passage 12 is exhausted rightwardly in FIG. 1 in spiral motion and a suction air stream is simultaneously generated at the inlet of the yarn path 12 of the first yarn twisting device 1. The cylindrical yarn passage 12 of the first yarn twisting device 1 is communicated with an expanding passage 14, which passage 14 has a tapered angle of $\beta°$ as shown in FIG. 2 in order that the air injected from the nozzles 13 may smoothly flow helically rightwardly in FIG. 1. According to the experiments, the respective angles of the nozzles 13 and expanding passage 14 were preferable $\alpha = 40°$ to $90°$ and $\beta = 1°$ to $3°$.

The second yarn twisting device 2 is similarly constructed to the first yarn twisting device 1, and has a yarn path or cylindrical yarn passage 15 formed therethrough, a chamber 16 to which compressed air is fed through a pipe connected to an air compressor (not shown), plural air injection nozzles 17 opened at the yarn passage 15, and an expanding passage 18 communicated with the cylindrical yarn passage 15. However, these air injection nozzles 17 of the second yarn twisting device 2 are preferably so opened as to inject the compressed air spirally in counter direction with respect to that of the air injection nozzles 13 of the first yarn twisting device 1. The respective angles $\alpha°$ and $\beta°$ of the nozzles 17 and expanding passage 18 are preferably the same as those of the first yarn twisting device 1 or may preferably be varied slightly depending upon the types of the yarns within the range as was heretofore defined.

Figure 4:
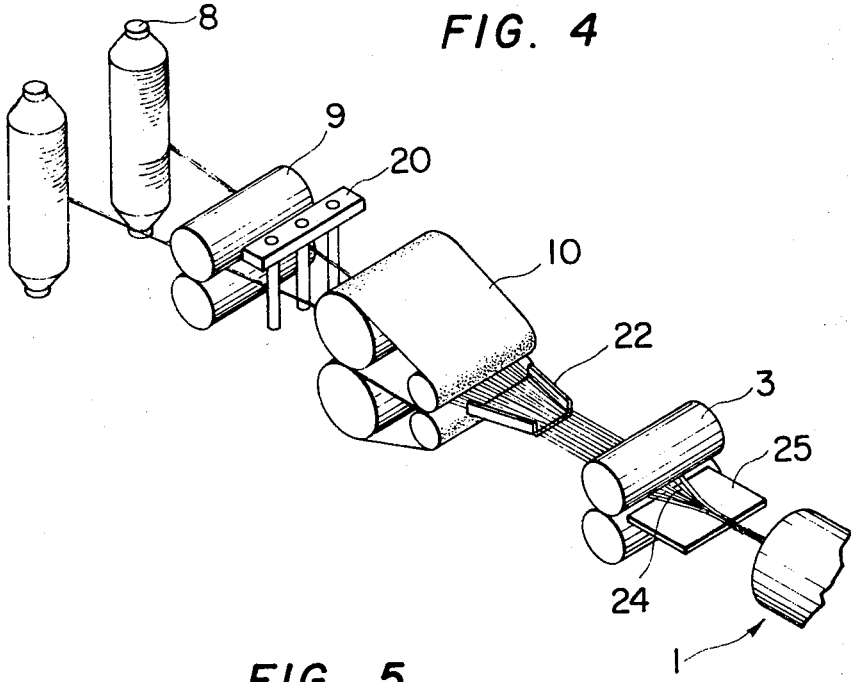
FIG. 4 is an enlarged perspective view of the drafting device of the spinning machine.
Figure 5:
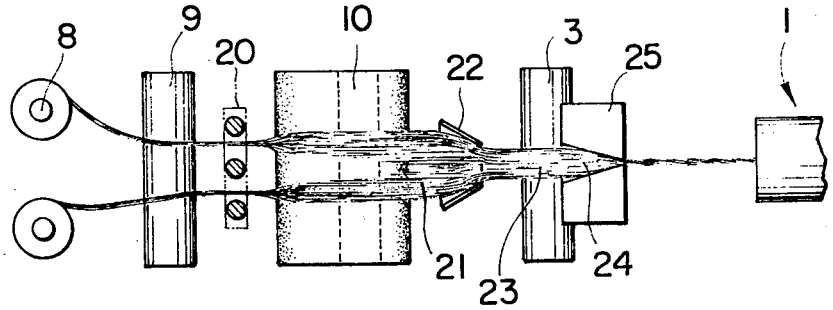
FIG. 5 is an enlarged plan view of the drafting device of the spinning machine with the upper rollers of the drafting device removed.

After the fibers 19 are fed into the back rollers 9, the fibers are maintained separate by a separator 20 shown in FIG. 4. The fibers 19 thus separated are considerably broadened in the aprons 10 as indicated by 21 and are then slightly contracted by a condenser 22, because as the fibers 19 are rapidly fed through the spinning machine even if the broadened fibers as indicated by 21 are fed through the front rollers 3, the broadened fibers are quickly fed straight into the first yarn twisting device 1 so that both sides of the fibers fed outside of the yarn twisting device 1 become loose. Therefore, the fibers thus slightly contracted as illustrated by 23 are fed through the front rollers 3 and are then fed into the first yarn twisting device 1. The fibers thus passed through the front rollers 3 are formed in V shape as shown by 24 by means of the twisting action applied by the first yarn twisting device 1. The fibers thus formed in V shape as indicated by 24 slip at both sides of the V shape due to the twisting action applied by the first yarn twisting device 1. The rotation prohibiting plate 25 is provided to prevent short fibers from being fed out of the twisting device 1 between the front rollers 3 and the nozzles 13 of the first yarn twisting device 1.

Figure 6:
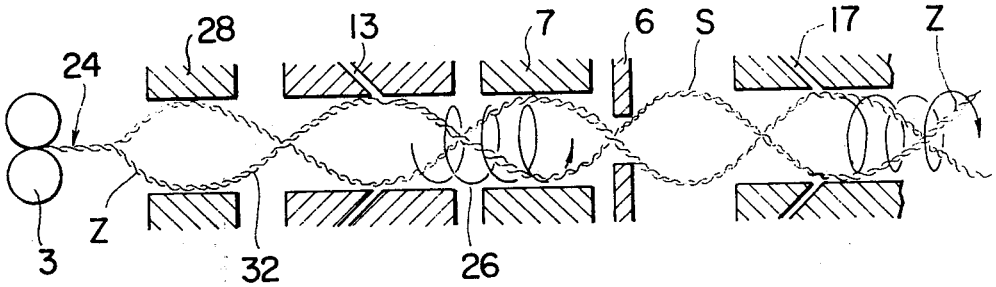
FIG. 6 is an enlarged explanatory view showing in principle the balloon state in the spinning machine.

The fibers fed out of the front rollers 3 are taken into the first yarn twisting device 1 by the suction caused by the air injection nozzles 13 of the first yarn twisting device 1 and are also twisted by the spiral air stream as indicated by 26 clockwise as seen in FIG. 6 with the result that a balloon is formed. In addition, Z twisting runs along the fibers toward the front rollers 3 at the front rollers side of the nozzles 13 by the twisting action of the nozzles 13 so that the fibers are formed in V shape as indicated by 24 and actual twisting occurs at the fibers. The fibers passed through the air injection nozzles 13 become untwisted by the false twisting action, with only the fibers which have been slipped at the V shape portion indicated by 24 and made to be free from the twist at one end of fibers are actually twisted in the S direction.

On the other hand, since the air injection nozzles 17 of the second yarn twisting device 2 are so injecting the compressed air helically in counter direction with respect to those of the air injection nozzles 13 of the first yarn twisting device 1, a helically counterclockwise air stream is produced as seen at the right in FIG. 6. Therefore, S twisting action is applied to the fibers before the air injection nozzles 17 of the second yarn twisting device 2 and such twisting runs along the fibers toward the nozzle 13 of the first yarn twisting device 1. Accordingly, S twisting exists along the fibers between the air compression nozzles 13 and 17 of the first and second yarn twisting devices 1 and 2, respectively.

Also, ballooning takes place in the yarns in the first and second yarn twisting devices 1 and 2 by means of the helical air stream caused by the air injection nozzles 13 and 17 of the first and second yarn twisting devices 1 and 2, respectively. This ballooning causes a loosening action of the fibers 19 between the air injection nozzles 13 and 17 of the first and second yarn twisting devices 1 and 2, respectively. More particularly, fibers are relieved from twisting at the V shape position as indicated by 24 and are twisted in the S direction after passing through the air injection nozzles 13 of the first yarn twisting device 1 and are then ballooned in the untwisting tube 7 of the first yarn twisting device 1 so as to be again untwisted (which action will be hereinafter called "fiber loosening action") and the fibers are actually twisted on passing through the second yarn twisting device 2 so as to form the spun yarn.

Figure 7:
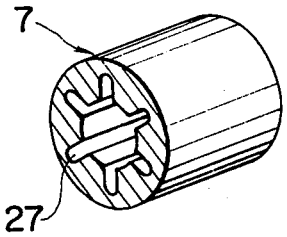
FIGS. 7 and 8 are perspective views of one embodiment of an untwisting device used in the spinning machine of the invention.

The untwisting tube 7 may preferably be, for example, in the shape as shown in FIG. 7. The yarn passes through the cylindrical fiber untwisting tube 7 upon receiving the ballooning action and the fibers which are around the periphery of the fiber bundle are contacted with the inner wall of the untwisting tube and are hit by the grooved strips 27 formed on the inner wall of the untwisting tube 7 so that the fibers are loosened and detached from the fiber bundle at one end of the fibers. These grooved strips 27 of the untwisting tube 7 also act to smoothly discharge the air injected from the nozzles 13 of the first yarn twisting device 1. It was recognized that this fiber loosening action cannot be sufficiently performed unless the fibers are twisted more than a predetermined degree between the air injection nozzles 13 and 17 of the first and second yarn twisting devices 1 and 2, respectively and also unless the yarns to be ballooned have more tension than a predetermined degree. Then, it is also important to form stable fiber loosening action and accordingly to form a stable balloon in the untwisting tube 7 in order to prevent the occurrence of yarn breakage. Therefore, it is possible to form a yarn having any strength by controlling this fiber loosening action. More particularly, the fiber loosening action can be controlled by adjusting the pressure of the air injection nozzles 13 and 17 of the first and second yarn twisting devices 1 and 2, the distance between the air injection nozzles 13 and 17, or the shape number and quality of material of the untwisting tube 7 of the first yarn twisting device 1.

The first yarn twisting device 1 has the balloon control ring 5, which has a ring 28 formed similarly to the untwisting tube 7 for suppressing the magnitude of the balloon to a predetermined degree caused by the air injection nozzles 13 therein so as to stabilize the balloon action in order to remove unstable elements or factors from the balloon after the air injection nozzles 13 and also for forming the fiber loosening action when the balloon frictionally engages the inner periphery of the ring 28 similar to the untwisting tube 7.

The second yarn twisting device 2 has the balloon control ring 6 which stabilizes the balloon in the fiber opening device by forcibly maintaining the exchanging point of the direction of the balloons because the balloons occurred by the nozzles 13 and 17 of the first and second yarn twisting devices 1 and 2, respectively are opposite to each other in action. This balloon control ring 6 holds the node of the balloon and has accordingly smaller inner diameter than those of the untwisting tube 7 and cylindrical yarn passage 15. Thus, according to the configuration and operations of the air injection type spinning machine thus constructed and operated, all types of fibers can be spun without being affected by the length of the fibers and blending ratio.

Figure 9:
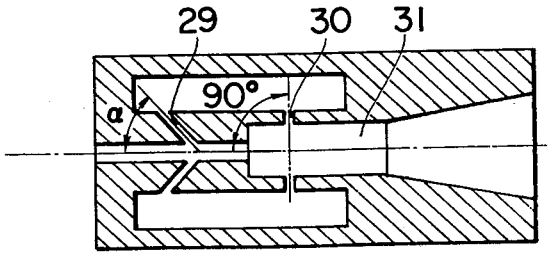
FIG. 9 is an enlarged sectional view of another embodiment of the air injection nozzle of the yarn twisting device of the invention.

Reference is now made to FIG. 9, which shows another embodiment of the air injection nozzles of the yarn twisting device. Although the air injection nozzles 13 and 17 opened at the cylindrical yarn passages 12 and 15, respectively of the first and second yarn twisting devices 1 and 2, respectively shown in FIGS. 1 and 2 have two functions to intake the fibers into the yarn twisting devices and to twist the fibers so as to balloon the fibers, these functions are clearly divided independently into the air injection nozzles 29 and 30. The air injection nozzles 29 are opened at $\alpha°$ with respect to the axis of the cylindrical yarn passage for intaking the fiber, and the air injection nozzles 30 are opened at right angle with respect to the axis of the cylindrical yarn passage 31 for strongly injecting the compressed air perpendicularly to the fibers in a manner tangentially toward the fibers so as to provide strong yarn twisting action. It should also be understood within the scope of the invention that the positions of the air injection nozzles 29 and 30 may be altered to each other.

Then, the spinning steps of the spun yarn will now be described with reference to the air injection type spinning machine thus constructed. The fibers 19 fed out by the back rollers 9 from the bobbin 8 are separated at the separator 20 and are then broadened at the aprons 10 and are then contracted at the condenser 22 and are then fed through the front rollers 3. Thereafter, the fibers thus fed are twisted at the first yarn twisting device 1 in a manner that the balloon by the first yarn twisting device 1 is stabilized by the balloon control ring 5 of the first yarn twisting device 1. Then, the balloon 32 is positively produced at the rear portion of the first yarn twisting device 1 and the fibers are then untwisted by the untwisting tube 7. Further, the fibers thus untwisted are again twisted by the second yarn twisting device 2 with the result that the fibers thus finished becomes similar to those spun by a ring spinning machine and the spun yarn are fed out by the delivery rollers 4.

The examples of the fibers spun by the air injection type spinning machine of this invention will now be described.

EXAMPLE 1

| | |
|---|---|
| Worsted roving: | two fibers feed 0.8 g./m |
| Mean length of fibers: | 76 mm |
| Count of yarn: | No40 |
| Draft ratio: | Approx. 30 times |
| Feeding speed: | 100 m/min. |
| Untwisting device: | one, shown in FIG. 7 |
| Air pressure conditions: | a) $P_1=5kg./a^2$ $P_2=4kg./a^2$<br>b) $P_1=4kg./a^2$ $P_2=3kg./a^2$ |

Using the untwisting device as shown in FIG. 7 under the air pressure condition (a), the strength of the yarn thus spun was 150 g. (coefficient of variance: 8%) and under the air pressure condition (b), the strength of the yarn thus spun was 110 g. (coefficient of variance: 13%). Both yarns thus spun by the air injection type spinning machine of the invention had almost the same appearance and feeling as those spun by the ring spinning machine and were sufficiently useful, and there occurred no breakage of the yarns during operation of the spinning machine. Thus, it is recognized that various yarns having different strength can be spun with the same spinning machine under different conditions.

EXAMPLE 2

Figure 8:
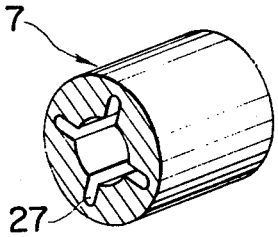

Using the same spinning conditions as those in the Example 1 but using different untwisting device as shown in FIG. 8 having four grooved strips under the air pressure condition (a) $P_1 = 5$ kg./$a^2$ and $P_2 = 4$ kg./$a^2$, the strength of the yarn thus spun was 135 g. (coefficient of variance: 15%). According to the microscopic photograph of the spun yarn, this yarn was more loosened and looked thicker than those spun in the Example 1 under the air pressure condition (a) so as to have proved clearly different fiber loosening functions depending upon the conditions adopted. The yarn thus spun had sufficient appearance and feeling for practical use and there was no worse conditions compared with those spun by the ring spinning machine.

EXAMPLE 3

| | |
|---|---|
| TC roving: | two fibers feed |
| Mean length of fibers: | 27 mm |
| (Tetlon 65% and cotton 35%) | |
| Count of yarn: | No.30 |
| Draft ratio: | approx. 50 times |
| Feeding speed: | 120 m/min. |
| Untwisting device: | one, shown in FIG. 6 |
| Air pressure conditions: | $P_1=2kg./a^2$ $P_2=6kg./a^2$ |

This example was spinning of short fibers, and the air pressure conditions are different from those in the previous two Examples. The distance between two nozzles was preferably shorter. The strength of the yarn thus spun was 334 g. (coefficient of variance: 8%). The appearance and feeling of the yarn thus spun were sufficiently useful and there occurred no breakage of yarns.

As clearly seen from the aforementioned Examples, all types of fibers can be stably spun without any restriction of the length of fibers. And, any strength of yarns can be obtained by controlling the conditions of the air injection type spinning machine of this invention, and if these conditions are selected as exemplified in the Examples, better configuration and finishment of the yarn than those spun by the ring spinning machine can be attained.

What is claimed is:

1. A spun yarn spinning apparatus having a pair of front rollers and a pair of delivery rollers, which comprises first yarn twisting means disposed between the front rollers and delivery rollers and including a cylindrical yarn passage therethrough and a plurality of air injection nozzles opening into the cylindrical yarn passage tangentially of the passage at a predetermined angle with respect to the central axis of the passage and toward the delivery rollers, an untwisting device disposed adjacent to the nozzles, and second yarn twisting means disposed between the front rollers and delivery rollers including a second cylindrical yarn passage therethrough and a plurality of air injection nozzles opening into the second cylindrical yarn passage tangentially of the passage at a predetermined angle with respect to the central axis of the passage and toward the delivery rollers, wherein said air injection nozzles of the second yarn twisting means are so oriented that the direction of the helical fluid jet stream caused thereby is in counter direction with respect to that caused by the air injection nozzles of the first yarn twisting means.

2. A spun yarn spinning apparatus according to claim 1, wherein said first yarn twisting means has a balloon control ring provided at the front roller side.

3. A spun yarn spinning apparatus according to claim 2, wherein said second yarn twisting means has a balloon control ring provided at the front roller side.

4. A spun yarn spinning apparatus according to claim 1, wherein said second yarn twisting means has a balloon control ring provided at the front roller side.

* * * * *